United States Patent [19]

Harris

[11] 4,010,686

[45] Mar. 8, 1977

[54] MEANS FOR APPLYING LIQUID TO A RELATIVELY MOVING SURFACE

[75] Inventor: John William Harris, Kettering, England

[73] Assignee: Timsons Limited, Kettering, England

[22] Filed: Apr. 7, 1975

[21] Appl. No.: 565,533

[52] U.S. Cl. ..... 101/148; 118/DIG. 15; 118/259; 118/300

[51] Int. Cl.[2] ..... B41L 23/00

[58] Field of Search ..... 101/147, 148, 366, 349, 101/177; 118/DIG. 15, 258, 259, 300, 301

[56] References Cited

UNITED STATES PATENTS

| | | | |
|---|---|---|---|
| 845,586 | 2/1907 | Sheehan | 101/148 X |
| 1,438,408 | 12/1922 | Strawn | 101/366 X |
| 2,464,040 | 3/1949 | Huebner | 118/258 X |
| 2,622,520 | 12/1952 | Hauser et al. | 101/147 |
| 2,689,523 | 9/1954 | Koch | 101/147 |
| 3,143,065 | 8/1964 | Warczak | 101/147 |
| 3,237,277 | 3/1966 | Gallino | 118/259 X |
| 3,329,086 | 7/1967 | Pullen | 101/177 |
| 3,516,354 | 6/1970 | Heimlicher | 101/148 X |
| 3,890,898 | 6/1975 | Fischer | 101/148 |

FOREIGN PATENTS OR APPLICATIONS

| | | | |
|---|---|---|---|
| 175,956 | 2/1953 | Germany | 101/147 |
| 925,233 | 2/1955 | Germany | 101/147 |
| 297,861 | 4/1954 | Switzerland | 101/148 |
| 710,875 | 6/1954 | United Kingdom | 101/147 |

*Primary Examiner*—E. H. Eickholt
*Attorney, Agent, or Firm*—Hibben, Noyes & Bicknell, Ltd.

[57] ABSTRACT

A dampening device supplying water or other ink repellent liquid to the printing plate of a lithographic offset rotary printing press, such device comprising a rotary cylinder, the wall of which comprises an inner coarse mesh element supporting an outer fine mesh element that picks up water from a trough into which it dips and from which the water is projected as a spray by means of air impinging on the interior surface of the cylinder at a delivery station from a series of nozzles or a tube having an axial slot, the fine mesh element having a mesh size that will ensure that each aperture is spanned by the liquid, and the coarse mesh element having apertures of a size such that they are not so spanned, and the space between the cylinder and the printing plate or transfer cylinder of the printing press being unobstructed in the circumferential direction.

7 Claims, 8 Drawing Figures

MEANS FOR APPLYING LIQUID TO A RELATIVELY MOVING SURFACE

BACKGROUND OF THE INVENTION

Field of the Invention

This invention relates to a means for applying liquid in the form of a spray to a surface afforded by a relatively moving member (herein called the treated member) and over which such liquid is required to be distributed. Such means are referred to herein as being of the kind specified.

The invention has been developed primarily to meet the requirements which arise in lithographic offset rotary printing presses. In such presses the lithographic printing plate is mounted on a rotary cylinder (herein called the plate cylinder) and has non-printing areas which will accept, and are required to be moistened by, water or other ink repellent liquid, and printing areas which are required to be moistened by ink. The non-printing areas are moistened first and the aforesaid ink repellent liquid and the ink is of such composition (normally oil based) that it will then be accepted only on the printing areas.

It is important that the quantity of the aforesaid liquid delivered to the printing plate shall be controlled so that it is sufficient to wet the non-printing areas and hence be effective to prevent ink pick-up on these areas, but not so great that a surplus tends to run onto the printing areas and thereby prevent these being properly inked. The ratio of printing area to non-printing area varies appreciably in different classes of work and it is, therefore, necessary to be able to vary the supply of water or ink repellent liquid in conformity with such variations. Also there are other parameters of a variable character which require the quantity of said liquid to be varied from time to time.

SUMMARY OF THE INVENTION

The main object of the present invention is to provide a new or improved means of the kind specified which will meet these requirements more satisfactorily than those hitherto generally in use at the present time in lithographic offset rotary printing presses, but it will be understood that the invention is not so limited in its application and may be applied in other fields where similar or analogous requirements arise. Thus, the invention may be applied to a means for delivering a liquid in the form of a spray to a relatively moving surface for various purposes, for example dyeing, colouring, or imparting to the surface some non-visual characteristic such as resistant to rust or corrosion.

According to the invention we provide a dampening device comprising, a carrier member including a foraminous wall for temporarily retaining dampening liquid, means for supporting the carrier member with portions of said wall disposed respectively at a pick-up station and at a delivery station spaced therefrom, drive means for cyclically moving the carrier member to move said wall along a path through the pick-up station and the delivery station, means for supplying the liquid to wall portion at the pick-up station, and means for directing a flow of gas onto one face of the wall portion at the delivery station, and wherein said foraminous wall incorporates apertures of a sufficiently small size to ensure that they will all reliably be spanned by a film of the liquid when travelling between the pick-up station and the delivery station, and thereby ensure that a predetermined quantity of the liquid will be transported to the delivery station in each cycle of movement of the carrier member, the means for directing the flow of gas provides for gas flow impinging on the wall portion at the delivery station only between predetermined boundaries extending transversely of the direction of movement of this wall portion and spaced from each other, at a velocity sufficient reliably to dislodge the liquid in each aperture between said boundaries and project the liquid in the form of a spray.

It will be understood that the movement of said carrier member for effecting advancement of said wall thereof from the pick-up station to the delivery station is separate from relative movement which may be effected between said carrier member and said treated member. It is contemplated that ordinarily the device in accordance with the invention for applying the liquid will be mounted to occupy a stationary position and the treated member will undergo any form of movement appropriate to its form or function passed the means for applying the liquid. It would, however, be within the scope of the invention, in cases where the treated member is more conveniently held in a stationary position while undergoing treatment, for the device in accordance with the invention to be moved bodily (and in this case such movement would be additional to the movement of the carrier member already referred to).

Each of the apertures of said wall of the carrier member may have its smallest cross-sectional dimension equal to, or less than, 0.0625 inches (1.6 mm.) and the means for directing the flow of gas may be adapted to deliver gas of a velocity equal to, or exceeding, 1000 feet per minute. These parameters provide reliable transportation of liquid such as water, or water with additives commonly employed in the art, for dampening lithographic printing plates and will provide reliable dislodgement and projection of the liquid so transported when it arrives at the delivery station.

In a preferred form of dampening device the wall of the carrier is of cylindrical form and comprises an inner foraminous element embraced by and supporting an outer foraminous element, the minimum aperture size of the inner element being sufficiently large to ensure that the apertures thereof reliably do not become spanned by a film of the liquid when moving from the pick-up station to the delivery station, and the drive means is adapted to rotate the carrier member about the axis of the cylindrical wall.

The inner foraminous element may comprise a mesh of relatively coarse filaments affording a relatively large aperture size such that it is able to perform its required supporting function for the outer foraminous element without transporting liquid by way of liquid spanned apertures from the pick-up station to the delivery station, and the outer foraminous element may comprise a mesh of relatively fine filaments affording an aperture size such as reliably to be spanned by said liquid as aforesaid.

One of the problems encountered in ensuring uniform distribution of the dampening liquid on the treated member is that droplets of the liquid may collect on any structure intervening between any spray producing device employed for such dampening and the treated member, and when these droplets reach a sufficiently large size they become parted from the surface of the structure on which they have collected, partly under the influence of gravity and partly under the influence of the velocity of the gaseous constituent producing the spray, and arrive randomly over the surface to be treated.

It is thus preferred that in the device of the present invention the boundaries of the spray projected from the wall portion of the carrier member and which extend transversely of the direction of movement of said wall portion are determined wholly by the corresponding boundaries of the area on which gas flow impinges on said wall portion. Thus the means for delivering gas may comprise a row of nozzles each of a form to deliver a thin plate-like gas stream and arranged in a manner such that the individual gas streams are substantially coplanar in a plane transverse to the direction of movement of the wall portion at the delivery station. Alternatively, the means for delivering gas may comprise a tubular member extending with its axis transversely of the direction of movement of said wall portion at the delivery station and is situated thereat, such tubular member having a slot facing towards said wall portion and sub-divided by a partition means into a plurality of individual outlets for promoting laminar as distinct from turbulent flow of the gas.

As previously indicated the invention is intended to be applied principally to the dampening of lithographic plate of a lithographic offset rotary printing press. One form of such press to which the invention may be applied with especial advantage is one in which the cylinder adapted to carry a lithographic printing plate is associated with drive means to drive such cylinder selectively in a forward or reversed direction of rotation. In this case the press would be provided with a means enabling the dampening device to be brought into operation to effect dampening of the printing plate selectively at two positions, one in advance of an inking station for one direction of rotation of the cylinder, and the other in advance of the inking station for the other direction of rotation of such cylinder.

Thus, separate dampening devices as aforesaid may be provided for operation at the two positions respectively and control means may be provided for rendering one or the other of these dampening devices operative as appropriate to the direction of rotation of the cylinder for carrying the printing plate.

Alternatively, a single dampening device may be provided in association with mounting means to enable it to be transferred from one of said positions to the other according to the direction of rotation of the cylinder carrying the printing plate.

BRIEF DESCRIPTION OF THE DRAWINGS

The invention will now be described, by way of example, with reference to the accompanying drawings wherein.

DESCRIPTION OF THE PREFERRED EMBODIMENT

Figure 1:
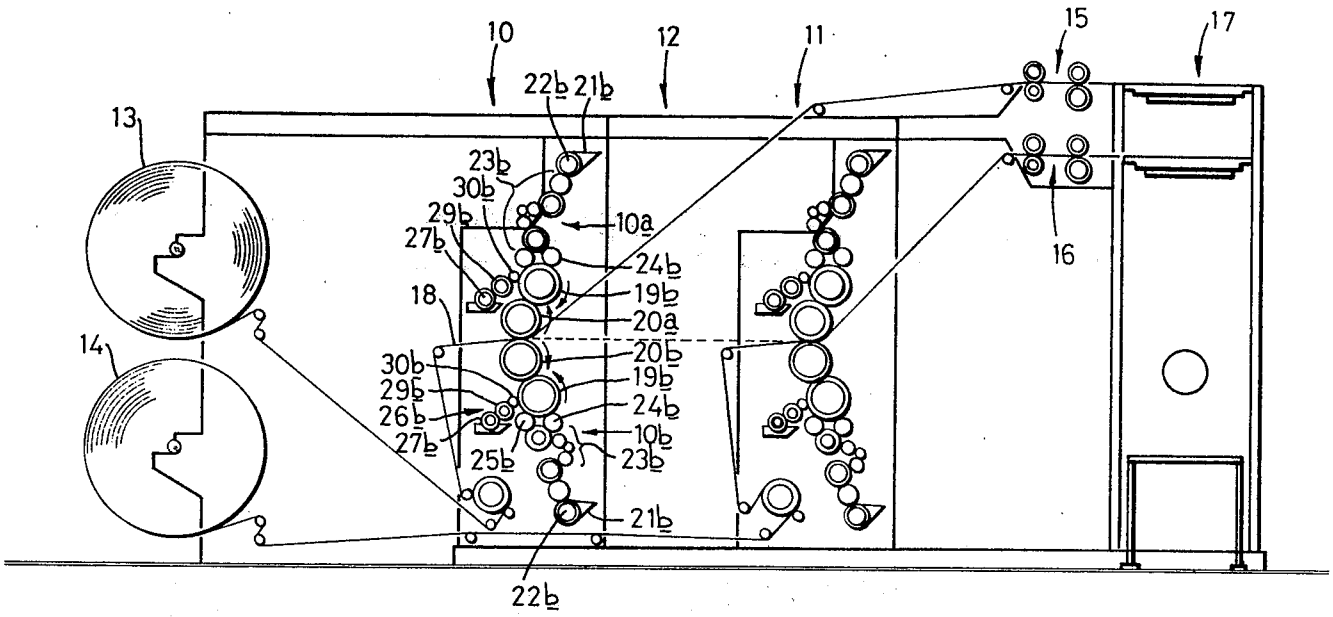
FIG. 1 is a diagrammatic view in side elevation showing the general arrangement of one embodiment of rotary offset lithographic press to which the invention is applied.

Referring firstly to FIG. 1, the press shown therein includes a plurality of printing sections or stands, two being shown at 10 and 11, supported at longitudinally spaced positions in a main frame or structure 12 which serves to support bulk supplies of paper in the form of reels 13, 14 fed respectively to sections 10 and 11 under the control of draw roll assemblies 15 and 16 before the respective webs of paper travel along respective feed paths to a chopper and folder device 17.

Since the printing sections and stands 10, 11 are identical so far as incorporation of an embodiment of the present invention therein is concerned, reference will be made to only one of these sections or stands, namely 10. Likewise the individual sections or stands such as 10 each incorporate upper and lower printing units such as **10*a*, 10*b* for printing respectively on the upper and lower faces of the web of paper 18 fed thereto, and since again application of the invention to these units is identical only one, namely the lower unit 10*b***, will be referred to, components therein being designated by a numeral with a suffix *b* and corresponding components in the unit **10*a*** being noted by corresponding references with the suffix *a*.

The printing unit **10*b* comprises a printing cylinder 19*b* adapted to carry one or more lithographic printing plates, non-printing areas of which are receptive to an ink repellent liquid which may be water or other known ink repellent liquids employed in the part of lithographic printing and hereinafter for convenience referred to as water. Other (printing) areas of the plate are receptive to ink which will normally be oil based and which will adhere to the non-printing areas provided that these are moistened so as to have a coating or film of water adhering to their exposed surfaces. The printing plate carried by the cylinder 19*b* cooperates with a blanket cylinder for transference of the inked image thereto preparatory to application to the paper 18**, the direction of rotation of the cylinders being as indicated by the arrows.

The means for supplying ink comprises an assembly of inking rollers including an ink fountain or reservoir **21*b* and fountain roller 22*b*** partially immersed therein or otherwise supplied with ink on its surface, transference being effected to the plate on the printing cylinder 19*b* through the intermediary of transfer rollers indicated generally at 23*b* including two final transfer rollers 24*b* and 25*b* in contact with the plate at an inking station.

One of the ink transfer rollers and the ink fountain roller 22*b* may be driven from the printing cylinder 19*b* or independently, but in the latter case to have peripheral speeds in conformity with the rolling (but non-slipping) engagement between successive rollers of the assembly.

Figure 2:
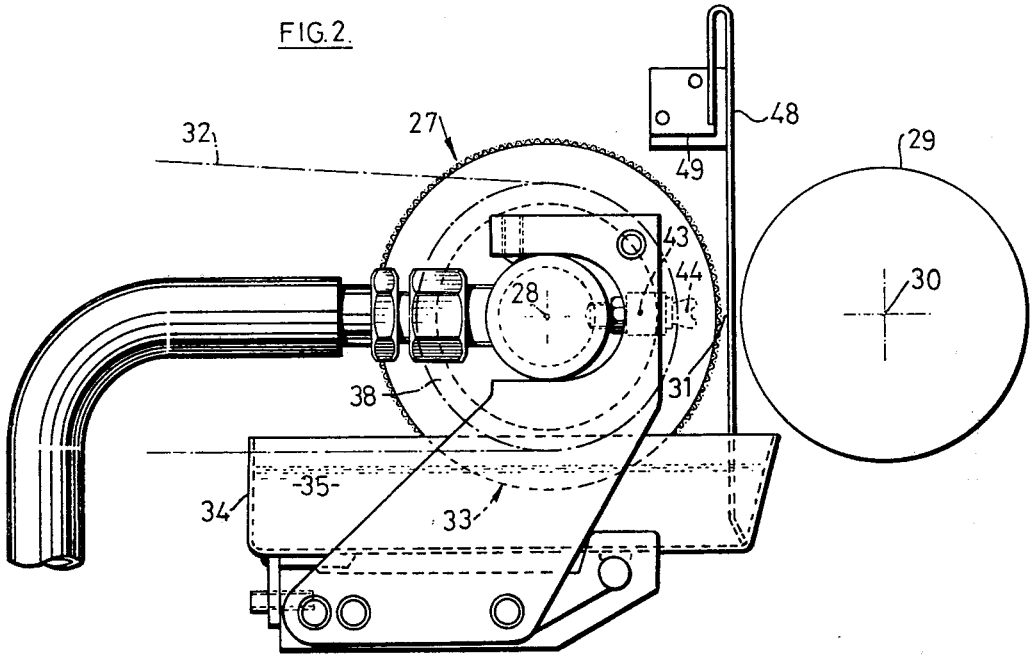
FIG. 2 is a fragmentary view on an enlarged scale showing in side elevation one embodiment of the means for applying water or other ink repellent liquid to the printing cylinders of the press of FIG. 1.
Figure 3:
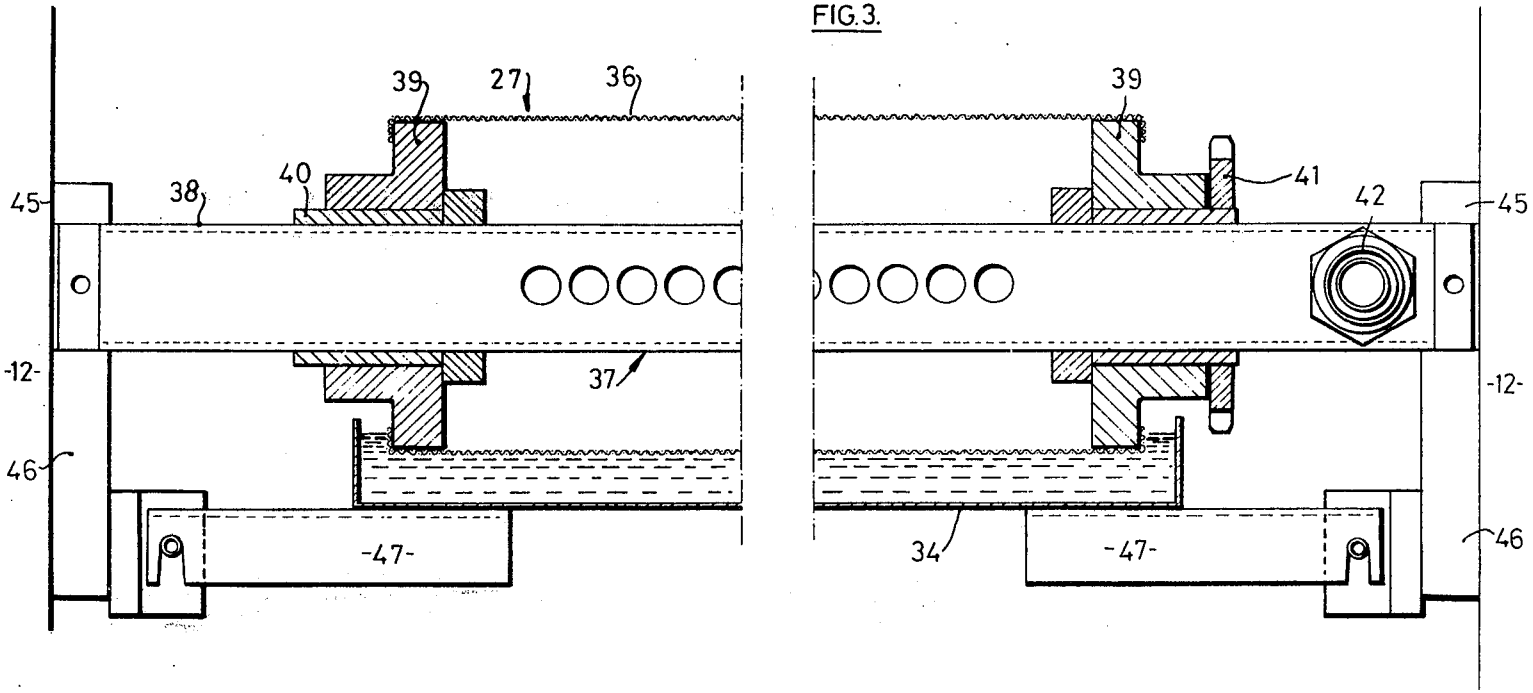
FIG. 3 is a view in end elevation of the means shown in FIG. 2.

For applying water to the plate a water applying means 26*b* is provided, one embodiment of which is shown in more detail in FIGS. 2 and 3. The water applying means comprises a carrier member 27 in the form of a cylinder journalled for rotation about a horizontal axis 28 and having its periphery spaced from a member to which the water is required to be transferred and which presents a moving surface. As shown typically in FIG. 2, this member (hereinbefore referred to as the treated member) comprises a roller 29. In the embodiment of FIG. 1 the cylinder 27*b* corresponds to the cylinder 27 of FIGS. 2 and 3, the roller 29*b* (which is a transfer roller) and a further transfer roller 30*b* is provided for transmitting the water to the surface of the printing plate on cylinder 19*b*. The roller 29 is journalled for rotation about an axis 30 which is parallel to, and spaced from, the axis 28 by a distance such that there is a space 31 between cylinder 27 and roller 29, such space constituting a delivery station across which water is transferred from the cylinder 27 to the roller 29 as hereinafter described.

The cylinder 27 is driven rotationally about its axis 28 from a motor through any suitable transmission means such as a driving belt or chain 32. Preferably the drive means, that is either the motor or the transmission means, incorporates speed adjustment means which may be either an electrical circuit if a variable speed motor is used or a variable velocity ratio gear, preferably steplessly adjustable.

Water is applied to the cylinder 27 at a pick-up station indicated generally at 33 and defined by the provision of a trough 34 for containing a quantity of water 35 in which the lowermost portion of the peripheral wall of the cylinder 27 is immersed.

The peripheral wall 36 of the cylinder 27 is of a foraminous character presenting a large number of small sized apertures, the shape and dimensions of which are such that they are able to be spanned by films of water which are thus temporarily retained in the apertures between the pick-up and delivery stations 33, 31.

Within the cylinder 27 is provided a means 37 for establishing a flow of air in a generally radial outward direction against the inner surface of the wall over a relatively short arc, typically 5°, at the delivery station 31 to expel the retained water from the aperture and cause it to be delivered in the form of a spray at the delivery station across the interspace between the cylinder 27 and roller 29 to coat the surface of the latter. The air flow means may comprise a tube 38 which is itself maintained non-rotatable during operation but which serves as a means for rotatably mounting the cylinder 27. Thus the cylinder 27 comprises end plates 39 containing tubular bearing bushes 40 rotatable on the exterior surface of the tube 38, one of the bearing bushes having fixed thereto a driving sprocket or pulley 41 around which the chain or belt 32 passes and which is secured to the adjacent end member 39.

Air may be supplied to the tube at one or both ends to any suitable fitting such as 42. Spaced apart along the length of the tube are air jet units 43 having delivery nozzles 44 having apertures shaped to provide thin plate-like air streams, e.g. analogous to a batswing type of gas burner. The air jets are preferably coplanar in a common plane passing through or near the axis 28 and the longitudinal spacing of the air jet units 43 is preferably such that the energy transferred to the retained water along the entire axially extending zone at the delivery station from which it is expelled from the foraminous wall is as nearly uniform along the length of the cylinder as possible.

Opposite ends of the tube 38 are supported between upper and lower bearer units 45, 46 of which one, for example the upper, may be quickly releasable from the body or frame of the press. The trough 34 may be supported by brackets 47 projecting laterally for engagement over pins, bolts or the like provided on the lower supporting block 46.

In order to provide control over the axial length of the zone over which water is delivered to the roller 29, laterally adjustable masking plates such as 48 may be provided, one at each side of the delivery station 31. Such plates may be slidably mounted on guide brackets 49 and provided with means (not shown) for securing them in any laterally adjusted position. Such plates may extend as shown into the trough 34 so that any water collecting on the faces thereof can run down the plates into the trough. It will be noted, however, that no masking plates are present in the circumferential direction with respect to cylinder 27 in either the approach path or exit path of a given part of this cylinder to and from the delivery station. The circumferential boundaries of the spray are determined wholly by the corresponding boundaries of the area over which air impinges on the inner surface of the wall 36 at the delivery station.

As hereinafter mentioned the entire means for delivering the water can readily be removed from one mounting position in the press and transferred to another position should the particular character of the printing operations be conducted or other factors render this desirable.

Figure 4:
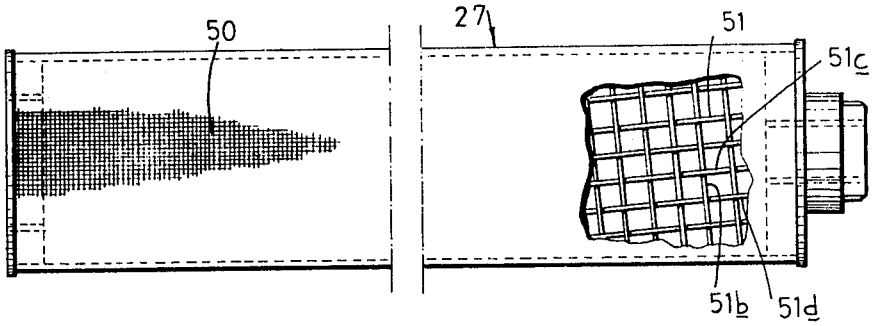
FIG. 4 is a fragmentary view of one embodiment of carrier member which may be utilised in the means of FIGS. 2 and 3, part of the finely apertured element being broken away to show the coarsely apertured element of the wall of the carrier member.
Figure 5:
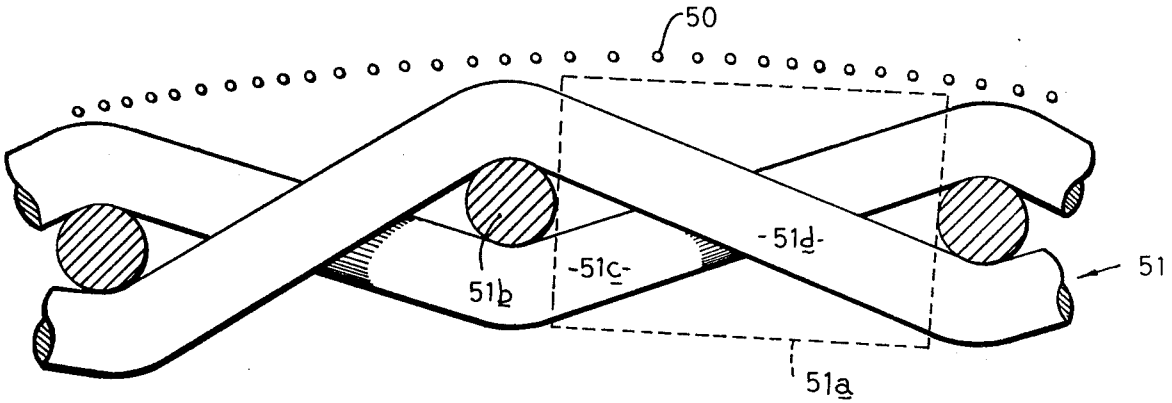
FIG. 5 is a fragmentary view in a cross-sectional plane at right angles to the axis of the carrier member and on a greatly enlarged scale showing a typical dimensional relationship between the coarsely and finely apertured elements.

Referring now to FIGS. 4 and 5 which show one embodiment of carrier member which may be employed in the means illustrated in FIGS. 2 and 3, it will be understood that the structure or form of the peripheral wall 27 plays an important part in determining the characteristics of the spray of water established across the interspace forming the delivery station 31.

In offset lithographic printing it is important to be able to control precisely the quantity of water delivered, the optimum value of which varies in accordance with a number of factors such, for example, as the speed of printing, the ratio of printing to non-printing areas in respect of the plate, and the characteristics of the ink, among others.

The form and arrangement of the apertures presented by the foraminous circumferential wall is selected to enable the water retained thereby to be expelled reliably in the required direction and with the required velocity by impingement of the air flow on the inner surface of the wall without general rise of pressure in the interior of the cylinder 27 giving rise to premature expulsion of the water at positions between the pick-up and delivery stations, and without random or systematic reflections of air flow using local expulsions of water at places other than the delivery station.

Further, the characteristics of the wall are designed to ensure that the pick-up of water per unit area of the wall shall be controlled within reasonably precise limits so that if substantially all of it is expelled at the delivery station it can be determined that precisely the right quantity is delivered for any given speed or other variable characteristic of the printing operation in progress.

Broadly speaking these objects are promoted by the use of a foraminous wall which comprises an outer finely apertured element 50 and an inner coarsely apertured element 51. For producing a spray of water or other liquid having similar physical properties (so far as the establishment of a film spanning an aperture is concerned) and using a square aperture, the side of the square should be equal to or less than one sixteenth of an inch (0.0625 inches or 1.6 mm.). For other shapes of aperture, i.e. apertures having more than one principal cross sectional dimension, the minimum cross-sectional dimension should have this value. In practice extremely satisfactory results have been obtained using fine mesh woven from stainless steel wire, the mesh size presenting a linear pitch of 80 apertures per inch, the wire utilised being of 39 s.w.g. (0.0052 inches diameter or 0.132 mm. diameter). The apertures thus formed are of generally square form as viewed in a plane normal to the mesh having a side measuring 0.0073 inches (0.18 mm.). Apertures of this form and dimensions will reliably retain a film of water spanning the aperture despite considerable variation in the surface tension or wetting charactertistics of the water and may thus be utilised for other ink repellent liquids which may be utilised in the lithographic printing art.

The coarsely apertured element may typically be composed of woven stainless steel wire, such wire having a diameter of 1.4 mm. and the mesh having rectangular apertures, the side of which measures 7 mm.

The primary function of the coarsely apertured element 51 is to act as a backing member providing mechanical support for the finely apertured element 50 ensuring that the latter remains truly cylindrical in shape during rotation of the cylinder 27 and maintaining a constant dimensional relation between the boundaries of the space which constitute the delivery station. Thus, the element 50 may be assembled with the element 51 under a slight degree of tension circumferentially and, if desired, axially to maintain good contact between the inner face of the element 50 and the outer face of the element 51. For simplicity in FIG. 5, the strands of the wire mesh forming the element 50 and which run circumferentially with the cylinder have been omitted but such strands as well as those running axially have been shown for the coarsely apertured element 51.

It will be noted that the apertures afforded by the coarsely apertured element 51 are of a size such that they will not readily be spanned by the water or other said liquid and so the likelihood of a variable quantity of water being transported from the pick-up station to the delivery station by random or unsystematic spanning of one or more of these apertures is very much reduced if not entirely eliminated.

It will be noted that the wires 51*c*, 51*d* which run circumferentially of the cylinder 27 in the coarse mesh element 51 run in directions oblique to a reference plane at right angles tc the axis of the cylinder, i.e. are typically in helical planes.

This is important as avoiding systematic or permanent masking of any given circumferentially extending zone on the treated cylinder 29 (such zone having a width equal, or approximately so, to the diameter of the coarse mesh wire). This effect might occur were the wires 53*c*, 53*d* to lie in planes at right angles to the axis of a cylinder.

In order to ensure reliable expulsion at the delivery station, the velocity of air incident at the inner surface of the fine mesh element should be at least 1000 feet per minute. A typical velocity providing extremely satisfactory results is 5000 feet per minute.

It is to be noted particularly that, apart from the plates or baffles 48 which define the lateral boundaries of the discharge station, the latter is unobstructed, i.e. has no mask determining the circumferential boundaries, such being determined by the characteristics of the air jet fittings 43, 44 and the through flow characteristics afforded by the finely apertured, coarsely apertured elements of the wall of the cylinder. Any water collecting on baffles 48 will drain into trough 34.

Accordingly there is no accumulation of globules of liquid from masks or other solid state circumferential boundary elements and no risk that such globules will be transported randomly onto the treated member 29 and interfere with the accuracy as to the quantity of water delivered per unit area.

It is contemplated that the peripheral speed of the peripheral wall of the carrier member, namely cylinder 27, may be varied within wide limits dependent upon the quantity of liquid to be deposited. Typically, however, the peripheral speed may lie in the range 2 feet per minute to 120 feet per minute.

Figure 6:
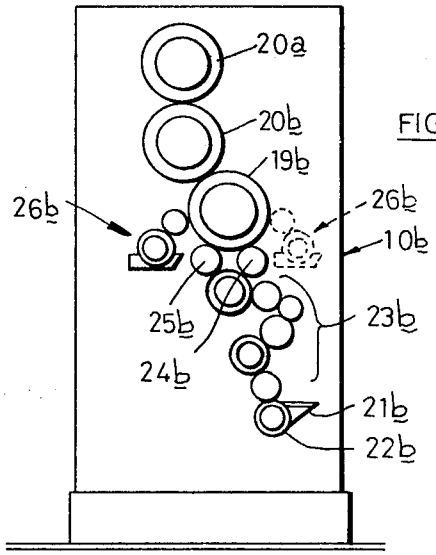
FIG. 6 is a fragmentary view in end elevation and partly in cross-section showing an alternative embodiment of means for applying water or ink repellent liquid and which may be employed in the means illustrated in FIGS. 2 and 3.
Figure 6:
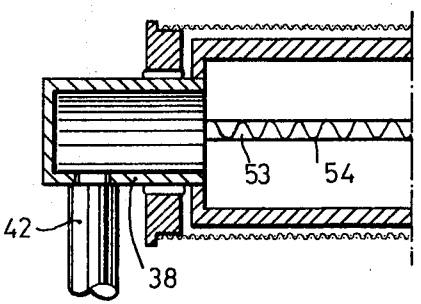
Figure 7:
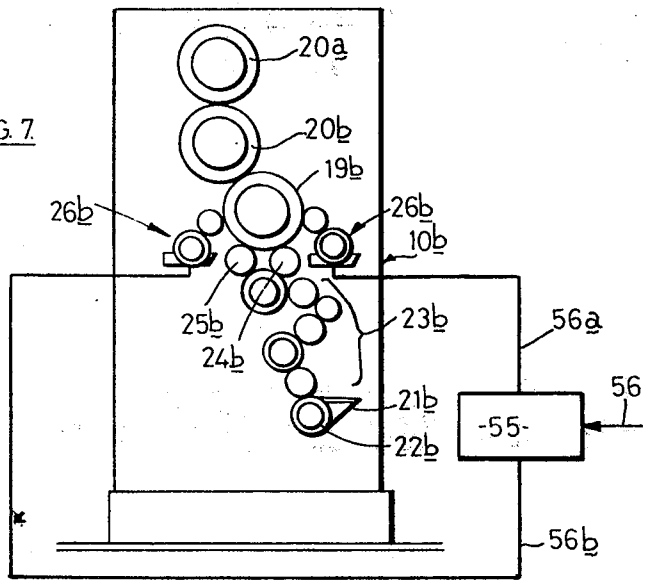
FIG. 7 is a diagrammatic view in side elevation of a reversible rotary off-set lithographic press showing the provision of two dampening devices for applying water or ink repellent liquid and capable of being brought into operation selectively according to the direction of rotation of the printing cylinder.

Referring now to FIG. 6, this illustrates an alternative form of means for establishing air flow in the interior of the cylinder 27. In this drawing parts already described are designated by reference numerals corresponding to those appearing in FIGS. 2, 3, 4 and 5 and the preceding description is to be deemed to apply to these. Although not shown in detail, the peripheral wall may be of the form described with reference to and as shown in FIGS. 4 and 5.

The modification principally illustrated in FIG. 6 is that, instead of employing a tube 38 with individual longitudinally spaced air jet fittings 43, 44, the tube 38 has an outlet in the form of an axially extending slot 53 or a radially projecting plate-like nozzle extending continuously along the length of the tube. The speeds of flow of the air issuing from longitudinally spaced nozzles or parts of the slot may be controlled to have equal, or approximately equal, values by flow control means in the tube. Such means may decrease the cross-sectional area of the flow path as this becomes more remote from the feed-in point for such air to the tube. Such slot or nozzle may contain a partition element 54, for example of sinuous form as shown, for the purpose of sub-dividing the slot or nozzle to individual compartments within which laminar, as distinct from turbulent flow can be maintained.

It will be understood that, although in FIG. 1 a dampening device is shown as applying water or ink repellent liquid to transfer rollers 29*b* and 30*b* to the plate. The dampening device may apply such water or liquid directly to the plate or through only one transfer roller. Alternatively the dampening device may apply the water or liquid spray onto the surface of one of the ink transfer rollers such as 25*b*. The direction of rotation of the roller 25*b* will be clockwise as seen in FIG. 1 and consequently the water or liquid film will be deposited on top of the ink film and will be applied to the printing plate first so as to become attached to the non-printing areas and inhibit these with respect to ink acceptance.

Figure 8:
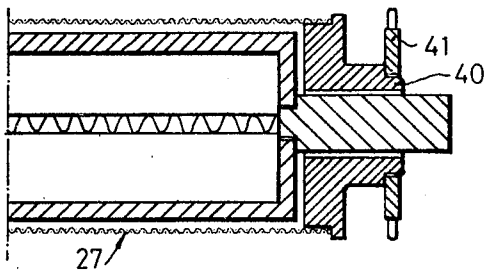
FIG. 8 is a view similar to FIG. 9 showing an alternative embodiment of reversible rotary offset lithographic press.

Referring now to FIG. 8, this illustrates an embodiment of the invention as applied to a rotary offset lithographic press of the reversible type. In this press components corresponding to those of FIG. 1 (the lower section of printing unit 10 are designated by like references and the preceding description will be deemed to apply. In this case drive means is provided for the press to enable the printing cylinder **19*b*** to be rotated clockwise or anticlockwise selectively.

Accordingly two dampening devices **26*b*1 and 26*b*2** are provided at positions spaced angularly about the axis of the printing cylinder so as to apply the water or liquid in advance of the printing station, applicable in the one case to clockwise rotation of the cylinder and in the other case to anti-clockwise rotation.

Means for selectively bringing one or the other of the dampening devices **26*b*1 or 26*b*2 into operation may comprise a selector valve 55 connected in an air supply pipe system 56, 56*a*, 56*b* leading to the pipe 38 of the dampening device in each case. If desired an interlock system may be provided for establishing that only the appropriate valve is open at any given time having regard to the direction of rotation of the printing cylinder 19*b***.

Alternatively, as illustrated in FIG. 9, mounting means may be provided for a single dampening device to allow this to be transferred from the position **26*b*1 to the position 26*b*2 indicated in broken lines according to the direction of rotation of the printing cylinder 19*b* so that water or liquid film is applied to the printing plate in advance of the inking station, i.e. transfer roll 24*b* or 25*b*** for clockwise and anti-clockwise rotation of the printing cylinder respectively.

Whilst it is preferred that the carrier member of the dampening device shall be a rotary cylinder, it will be understood that it would be within the scope of the invention for some other form of carrier member presenting a foraminous wall to be employed. For example, the carrier member may be in the form of a flexible travelling band or belt. In such a construction finely and coarsely apertured elements may be employed, such elements being secured together so that the belt travels as a unit between the pick-up and delivery stations.

I claim:

1. In a dampening device comprising, a carrier member including a foraminous wall for temporarily retaining dampening liquid, means for supporting the carrier member with portions of said wall disposed respectively at a pick-up station and at a delivery station spaced therefrom, drive means for cyclically moving the carrier member to move said wall along a path through the pick-up station and the delivery station, means for supplying the liquid to the wall portion at the pick-up station, and means for directing a flow of gas onto one face of the wall portion at the delivery station; the improvement wherein:

a. said foraminous wall incorporates apertures and is of cylindrical form and comprises
   i. an inner foraminous element,
   ii. an outer foraminous element embracing and supported by said inner foraminous element,
b. the apertures of said outer element are of a sufficiently small size to ensure that they will all reliably be spanned by a film of the liquid when travelling between the pick-up station and the delivery station, and thereby ensure that a predetermined quantity of the liquid will be transported to the delivery station in each cycle of movement of the carrier member,
c. the minimum aperture size of said inner element is sufficiently large to ensure that the apertures thereof reliably are free from spanning by a film of the liquid when travelling from the pick-up station to the delivery station,
d. the means for directing the flow of gas provides for gas flow
   i. impinging on the wall portion at the station only between predetermined boundaries extending transversely of the direction of movement of this wall portion and spaced from each other,
   ii. at a velocity sufficient reliably to dislodge the liquid in each apertures between said boundaries and project the liquid in the form of a spray,
e. the drive means provides for rotation of the carrier member about the axis of its cylindrical wall.

2. A dampening device as claimed in claim 1 wherein:

a. the inner foraminous element comprises a mesh of relatively coarse filaments affording a relatively large aperture size providing support to the outer foraminous element but without transporting liquid by way of liquid spanned apertures from the pick-up station to the delivery station,
b. the outer foraminous element comprises a mesh of relatively fine filaments affording an aperture size sufficiently small to be reliably spanned by said liquid.

3. A dampening device as claimed in claim 1 wherein aperture distribution of the inner foraminous element is such that imperforate portions thereof at positions spaced circumferentially around the element occupy different axial positions, so that at the delivery station any given axial position is not constantly masked by an imperforate portion of the inner foraminous element.

4. A dampening device according to claim 2 wherein filaments of the inner foraminous element and which run circumferentially thereof are oblique with respect to a reference plane normal to the axis of the carrier member.

5. A dampening device as claimed in claim 1 wherein:

a. the means for delivering gas comprises a row of nozzles,
b. each of said nozzles includes means to establish delivery of the gas in a thin plate-like gas stream,
c. the nozzles are positioned relatively to establish that said respective gas streams are substantially coplanar with each other and lie in a plane transverse to the direction of movement of the wall portion at the delivery station.

6. A dampening device as claimed in claim 1 wherein:

a. the means delivering gas comprises a tubular member extending with its axis transversely of the direction of movement of the wall portion at the delivery station and is situated thereat,
b. said tubular member has a slot facing towards said wall portion,
c. partition means are provided in said slot sub-dividing said slot into a plurality of individual outlets for promoting laminar as distinct from turbulent flow of the gas.

7. In a lithographic offset rotary press having a body or supporting structure, a cylinder for carrying a printing plate, drive means for rotating said cylinder, means for feeding paper into image transfer relation with said printing plate, and means for inking said plate:- the improvement comprising the provision of a dampening device for dampening areas of said plate required to be non-receptive to said ink with an ink repellent liquid, said device comprising:

a. a carrier member including a cylindrical foraminous wall for temporarily retaining the dampening liquid, b. means for supporting the carrier member with portions of said wall disposed respectively at a pick-up station and at a delivery station spaced therefrom, c. drive means for rotating the carrier member about the axis of its cylindrical wall to move said wall along a path through the pick-up station to the delivery station, d. means for supplying the liquid to said wall at a pick-up station, e. means for directing a flow of gas onto one face of said wall portion at the delivery station, and wherein:

f. said foraminous wall comprises an outer foraminous element in the form of a mesh of relatively fine filaments affording apertures each having the smallest of its principal cross-sectional dimensions below a limit of 0.0625 inch so as to ensure spanning thereof by a film of the liquid when travelling between the pick-up station and the delivery station thereby ensuring that a predetermined quantity of the liquid will be transported to the delivery station in each cycle of movement of the carrier member, g. said wall further comprises an inner foraminous element in the form of a mesh of relatively course filaments affording a relatively large aperture size such that the mesh supports the outer element without transporting liquid by way of liquid spanned apertures from the pick-up station to the delivery station, h. the means for directing the flow of gas provides gas flow i. impinging on the wall portion at the delivery station only between predetermined boundaries extending transversely of the direction of movement of said wall portion and spaced from each other, ii. at a velocity sufficient reliably to dislodge the liquid in each aperture between said boundaries and project the liquid in the form of a spray.

* * * * *